US010900200B2

(12) United States Patent
Tanaka

(10) Patent No.: US 10,900,200 B2
(45) Date of Patent: Jan. 26, 2021

(54) HYDRAULIC DRIVE DEVICE FOR WORK VEHICLE

(71) Applicant: Hitachi Construction Machinery Co., Ltd., Tokyo (JP)

(72) Inventor: Shinichiro Tanaka, Hyogo (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 28 days.

(21) Appl. No.: 16/328,840

(22) PCT Filed: Mar. 7, 2018

(86) PCT No.: PCT/JP2018/008864
§ 371 (c)(1),
(2) Date: Feb. 27, 2019

(87) PCT Pub. No.: WO2018/180323
PCT Pub. Date: Oct. 4, 2018

(65) Prior Publication Data

US 2019/0249396 A1 Aug. 15, 2019

(30) Foreign Application Priority Data

Mar. 30, 2017 (JP) ..... 2017-068952

(51) Int. Cl.
*E02F 9/22* (2006.01)
*F15B 11/10* (2006.01)
(Continued)

(52) U.S. Cl.
CPC ..... *E02F 9/2228* (2013.01); *E02F 9/22* (2013.01); *E02F 9/2267* (2013.01);
(Continued)

(58) Field of Classification Search
CPC ..... F15B 2211/20576; F15B 11/02; F15B 11/028; F15B 11/10; E02F 9/2292; E02F 9/2267; E02F 9/2228
See application file for complete search history.

(56) References Cited

U.S. PATENT DOCUMENTS 6,112,848 A * 9/2000 Ang ..... F16F 15/08 181/207
2007/0125078 A1 6/2007 Tanaka et al.

FOREIGN PATENT DOCUMENTS

CN 203926175 U 11/2014
JP 6-40238 Y2 10/1994
(Continued)

OTHER PUBLICATIONS

International Search Report (PCT/ISA/210) issued in PCT Application No. PCT/JP2018/008864 dated May 29, 2018 with English translation (three (3) pages).
(Continued)

*Primary Examiner* — Abiy Teka
(74) *Attorney, Agent, or Firm* — Crowell & Moring LLP

(57) ABSTRACT

This hydraulic drive device for a work vehicle includes a main pump (1) of a variable displacement type or a fixed displacement type discharging pressure oil, a main flow passage (F1) for supplying pressure oil of the main pump to an actuator, a sub-pump (5) of a fixed displacement type discharging pressure oil, a sub-flow passage (F2) for making pressure oil of the sub-pump merge with the main flow passage and supplying the pressure oil to the actuator (2), a merging directional valve (6A) for connecting or cutting off the main flow passage and the sub-flow passage, a controller (30) for controlling operation of the merging directional valve, and a relief valve (7A) arranged in the sub-flow passage, in which the relief valve has a pressure override
(Continued)

characteristic having a tendency that the relief pressure increases from a cracking pressure to a set pressure as a relief flow rate increases.

4 Claims, 20 Drawing Sheets

(51) Int. Cl.
*F15B 11/02* (2006.01)
*F15B 11/028* (2006.01)

(52) U.S. Cl.
CPC ..... *E02F 9/2292* (2013.01); *E02F 9/2296* (2013.01); *F15B 11/02* (2013.01); *F15B 11/028* (2013.01); *F15B 11/10* (2013.01); *E02F 9/2285* (2013.01); *F15B 2211/20538* (2013.01); *F15B 2211/20546* (2013.01); *F15B 2211/20576* (2013.01); *F15B 2211/30525* (2013.01); *F15B 2211/329* (2013.01); *F15B 2211/55* (2013.01); *F15B 2211/6306* (2013.01); *F15B 2211/6346* (2013.01); *F15B 2211/7053* (2013.01)

(56) References Cited

FOREIGN PATENT DOCUMENTS

| | | | |
|---|---|---|---|
| JP | 10-266274 | A | 10/1998 |
| JP | 2006-83990 | A | 3/2006 |

OTHER PUBLICATIONS

Japanese-language Written Opinion (PCT/ISA/237) issued in PCT Application No. PCT/JP2018/008864 dated May 29, 2018 (five (5) pages).

* cited by examiner

HYDRAULIC DRIVE DEVICE FOR WORK VEHICLE

TECHNICAL FIELD

The present invention relates to a hydraulic drive device for a work vehicle represented by a wheel loader for example.

BACKGROUND ART

As a background art of the present technical field, in Patent Literature 1 for example, there is described "a rising speed control device for a cargo handling vehicle which is characterized that, in a hydraulic circuit including a pair of lift cylinders that raise/lower a mast, making pressure oil from a first pump and pressure oil from a second pump merge each other to be supplied to a main valve, and increasing the extension speed of the lift cylinders, an unload valve is provided in the hydraulic circuit, the unload valve being operated so as to release the pressure oil from the first pump to a tank from a return passage when pressure of the hydraulic circuit reaches a set value, that a detector sensor is attached to the mast, the detector sensor detecting the front of an stroke end of the mast, and that a directional valve is arranged in the hydraulic circuit, the directional valve operating the unload valve based on an output signal of the detector sensor."

According to the configuration described in Patent Literature 1, by operating the unload valve, since the pressure oil from the first pump is released to the tank from the return passage, the pressure oil comes to be supplied to the lift cylinders only from the second pump. As a result, the extension speed of the lift cylinders becomes slow, the impact and the collision sound are reduced even when the mast reaches the stroke end, and a feeling of fatigue of an operator can be alleviated.

CITATION LIST

Patent Literature

Patent Literature 1: Japanese Examined Utility Model Application Publication No. HEI6-40238

SUMMARY OF INVENTION

Technical Problem

According to Patent Literature 1, since the flow rate of the pressure oil supplied to the lift cylinders reduces sharply when the unload valve is operated, it is still probable that a large impact is imparted to an operator operating the lift cylinders. However, in Patent Literature 1, no measure for relaxing the sharp change of the flow rate of the time of unloading the joining circuit has been taken, and a room for improvement is left.

The present invention has been achieved in view of the circumstances described above, and its object is to provide a hydraulic drive device for a work vehicle which can reduce an impact imparted to an operator operating an actuator.

Solution to Problem

In order to achieve the object described above, an aspect of a hydraulic drive device for a work vehicle according to the present invention is characterized to include a main pump of a variable displacement type or a fixed displacement type, the main pump discharging pressure oil, a main flow passage for supplying pressure oil of the main pump to an actuator, a sub-pump of a fixed displacement type discharging pressure oil, a sub-flow passage for making pressure oil of the sub-pump merge with the main flow passage and supplying the pressure oil to the actuator, a merging directional valve for connecting or cutting off the main flow passage and the sub-flow passage, a controller for controlling operation of the merging directional valve, and a relief valve arranged in the sub-flow passage, in which the relief valve has a pressure override characteristic having a tendency that the relief pressure increases from a cracking pressure to a set pressure as a relief flow rate increases.

Advantageous Effects of Invention

According to the present invention, it is possible to provide a hydraulic drive device for a work vehicle which can reduce an impact imparted to an operator operating an actuator. Also, problems, configurations, and effects other than those described above will be clarified by explanation of embodiments described below.

DESCRIPTION OF EMBODIMENTS

Figure 1:
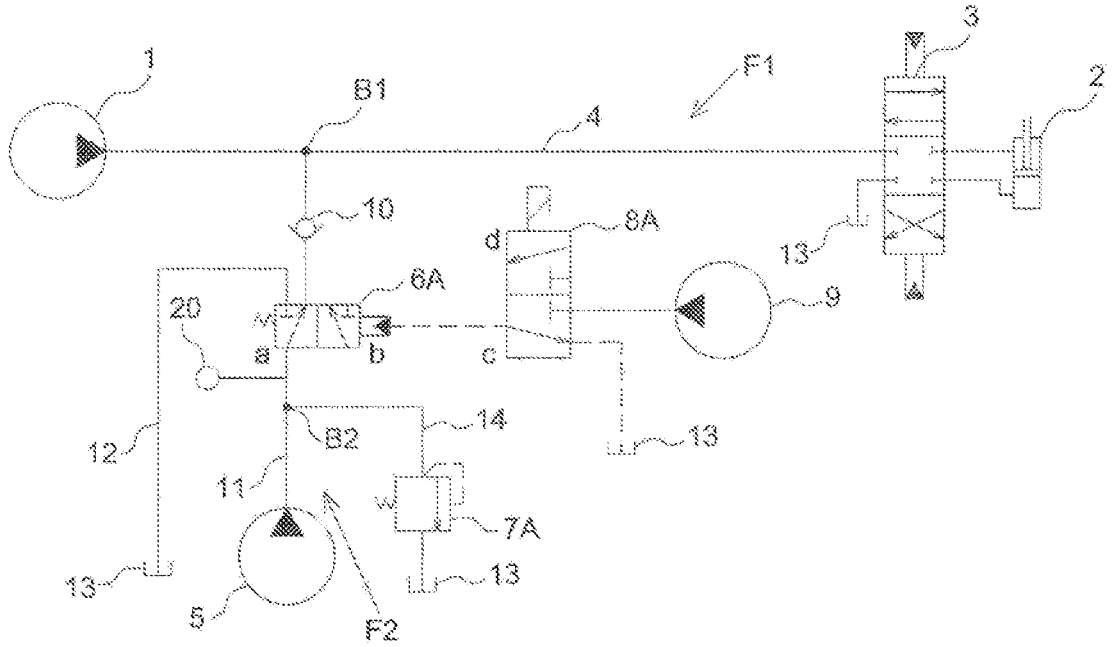
FIG. 1 is a hydraulic circuit diagram that shows a hydraulic drive device for a work vehicle according to a first embodiment of the present invention.

Hereinafter, embodiments of the present invention will be explained referring to the drawings. Also, in all of each embodiment described below, the present invention is applied to a hydraulic drive device for driving an arm cylinder (also called a hoist cylinder) of a wheel loader that is a work vehicle, however the present invention is not limited to them.

First Embodiment

FIG. 1 is a hydraulic circuit diagram that shows a hydraulic drive device for a work vehicle according to a first embodiment of the present invention. The hydraulic drive device shown in FIG. 1 is for driving an arm cylinder (actuator) 2 of a wheel loader, and includes a main flow passage F1 and a sub-flow passage F2 that merges with the main flow passage F1 at a merging point B1.

The main flow passage F1 is formed by connecting a main pump 1 and the arm cylinder 2 by a pipe 4 through a directional control valve 3. Pressure oil discharged from the main pump 1 flows through the main flow passage F1, and is supplied to the arm cylinder 2. With respect to the main pump 1, although a variable displacement type piston pump of a swash plate type for example is used, a pump of another variable displacement type and a pump of a fixed displacement type may be used.

The sub-flow passage F2 is formed by connecting a sub-pump 5 and the merging point B1 of the main flow passage F1 by a pipe 11. Pressure oil discharged from the sub-pump 5 merges with the main flow passage F1 from the sub-flow passage F2, flows through the main flow passage F1, and is supplied to the arm cylinder 2. With respect to the sub-pump 5, a fixed displacement type one is used, and a gear pump is used for example in the present embodiment in order to achieve a low cost.

In the sub-flow passage F2, an unload directional valve (merging directional valve) 6A is arranged between the sub-pump 5 and the merging point B1, and a check valve 10 is arranged on the downstream side of the unload directional valve 6A. This unload directional valve 6A is maintained normally at the position a, and is in a state of connecting the main flow passage F1 and the sub-flow passage F2 with each other. Therefore, pressure oil discharged from the sub-pump 5 flows to the main flow passage F1 without flowing backward through the check valve 10.

The unload directional valve 6A is operated by a directional solenoid valve 8A. This directional solenoid valve 8A is operated by a control signal from a controller 30 (refer to FIG. 3) described below, and guides pilot pressure from a pilot pump 9 to the unload directional valve 6A. Then, the pilot pressure is applied to the unload directional valve 6A, and the unload directional valve 6A is switched from the position a to the position b. When the unload directional valve 6A is switched to the position b, the main flow passage F1 and the sub-flow passage F2 are put into a state of being shut off with each other, the pipe 11 and a return pipe (return flow passage) 12 communicate with each other, pressure oil discharged from the sub-pump 5 flows through the return pipe (return flow passage) 12, and is returned to a tank 13.

Here, an event of shutting off the main flow passage F1 and the sub-flow passage F2 with each other and returning the pressure oil from the sub-pump 5 to the tank 13 is to be referred to as "unload" in the explanation below. By unloading, since all of the pressure oil within the sub-flow passage F2 is released to the tank 13, pressure inside the sub-flow passage F2 can be prevented from rising up abnormally, and the sub-flow passage F2 can be protected.

Also, in the sub-flow passage F2, a relief valve 7A is arranged. To be more specific, the relief valve 7A is arranged in a branch pipe 14 that branches at a branch point B2 that is positioned between the sub-pump 5 and the unload directional valve 6A, is operated when the pressure of the pressure oil discharged from the sub-pump 5 becomes a predetermined pressure, and returns (relieves) the pressure oil to the tank 13. Also, in the present embodiment, the set pressure of the relief valve 7A is set beforehand to a value slightly lower than the using maximum pressure of the sub-pump 5.

The relief valve 7A used in the present embodiment is characterized that one where the pressure override characteristic is inferior to normal (in other words, one where the pressure difference between the cracking pressure and the set pressure of the relief valve is large, the cracking pressure being a pressure at which the relief valve starts to open and a constant flow becomes noticeable) is used.

Figure 2A:
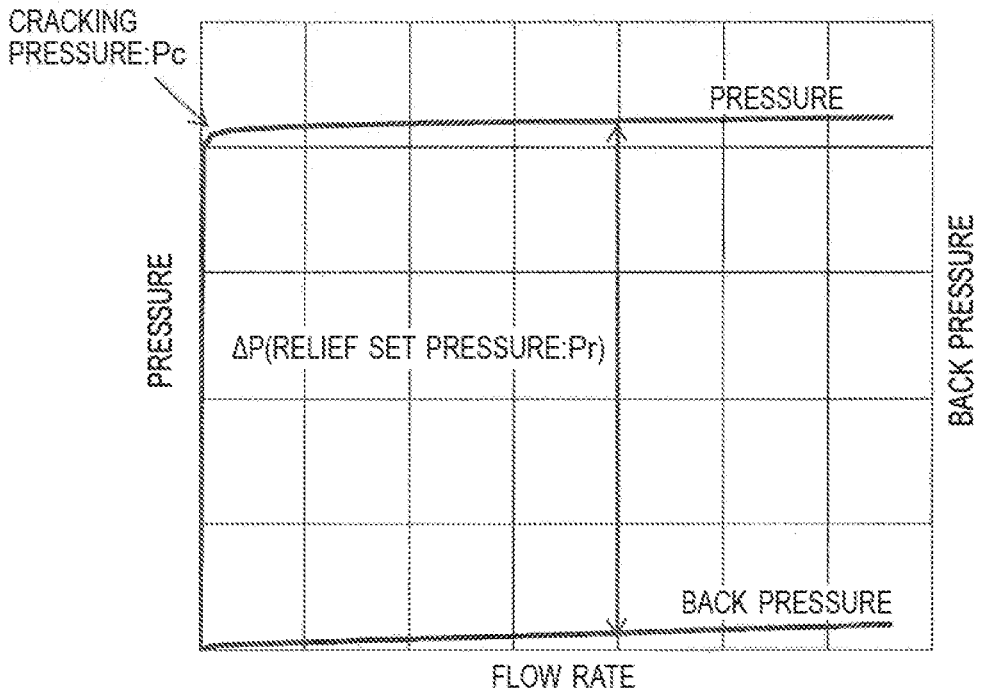
FIG. 2A is a drawing that shows a pressure override characteristic of an ordinary relief valve.

The pressure override characteristic of the relief valve 7A used in the present embodiment will be explained comparing with an ordinary pressure override characteristic. FIG. 2A is a drawing that shows a pressure override characteristic of an ordinary relief valve, and FIG. 2B is a drawing that shows the pressure override characteristic of the relief valve 7A of the present embodiment.

As shown in FIG. 2A, in an ordinary relief valve, the pressure difference between the cracking pressure Pc and the set pressure Pr of the relief valve is small. Therefore, when an ordinary relief valve is arranged in the sub-flow passage F2, if the pressure of the sub-flow passage F2 exceeds the cracking pressure Pc, the pressure oil returns to the tank 13 at once, and therefore the flow rate of the pressure oil flowing through the main flow passage F1 also reduces sharply.

Figure 2B:
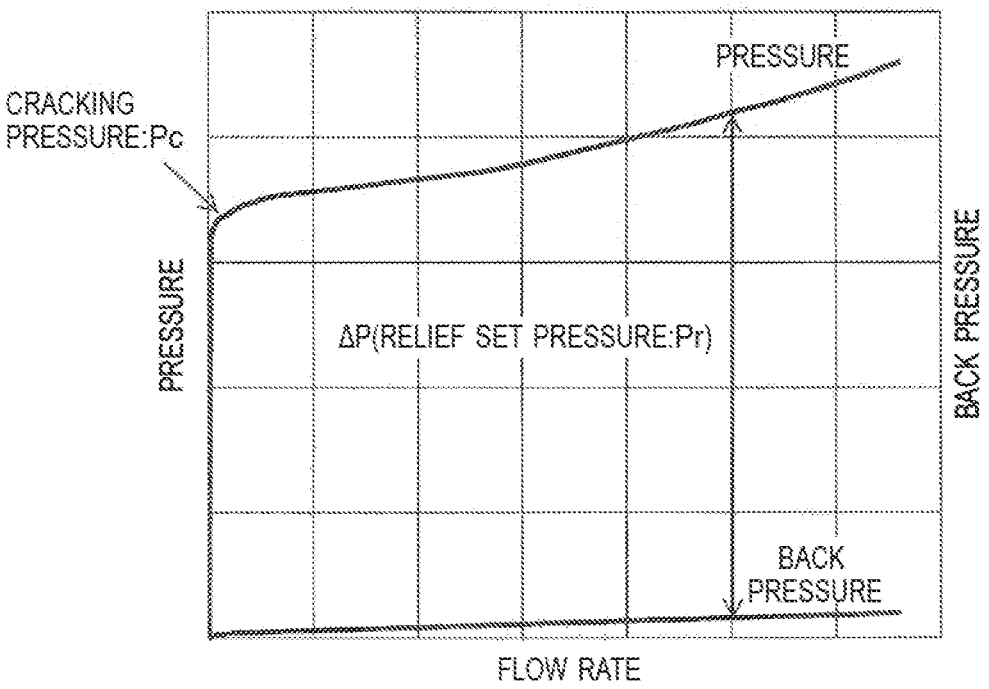
FIG. 2B is a drawing that shows a pressure override characteristic of a relief valve 7A of the present embodiment.

Meanwhile, as shown in FIG. 2B, the relief valve 7A used in the present embodiment has a pressure override characteristic having a tendency that the relief pressure increases from the cracking pressure Pc to the set pressure Pr as the relief flow rate increases. That is, the pressure difference between the cracking pressure Pc and the set pressure Pr is large. Therefore, when the relief valve 7A is arranged in the sub-flow passage F2, if the pressure of the sub-flow passage F2 exceeds the cracking pressure Pc, the pressure oil is returned gradually to the tank 13, and therefore the flow rate of the pressure oil flowing through the main flow passage F1 also reduces gradually. Thus, in the present embodiment, a relief valve whose pressure override characteristic is not excellent is preferable.

Figure 3A:
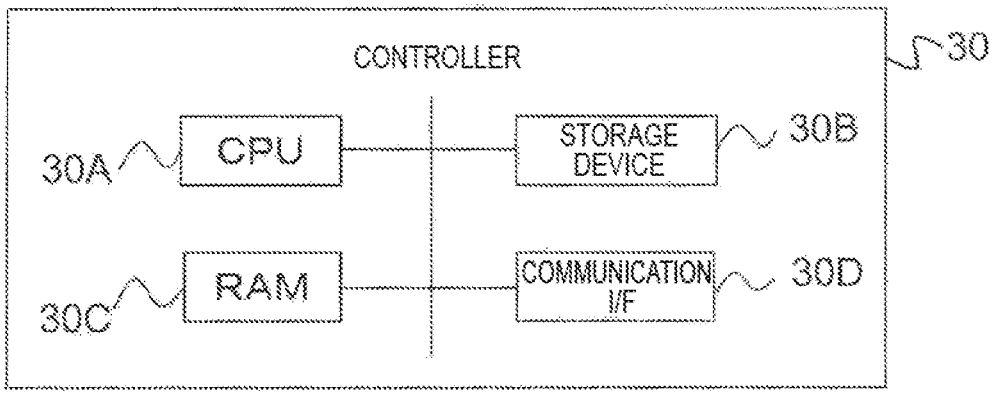
FIG. 3A is a hardware configuration diagram of a controller 30.

Next, the controller 30 controlling operation of the directional solenoid valve 8A will be explained. FIG. 3A is a hardware configuration diagram of the controller 30, and FIG. 3B is a functional block diagram of the controller 30.

As shown in FIG. 3A, the controller 30 is configured of hardware and software, the hardware including a CPU 30A that executes various kinds of calculations, a storage device 30B such as a ROM and HDD storing programs for executing calculation by the CPU 30A, a RAM 30C that becomes a working region when the CPU 30A executes the programs, and a communication interface (communication I/F) 30D that is an interface when data are transmitted/received to/from other devices, the software being stored in the storage device 30B and being executed by the CPU 30A. Each function of the controller 30 is achieved by that the CPU 30A loads various kinds of programs stored in the storage device 30B to the RAM 30C and executes the programs.

Figure 3B:
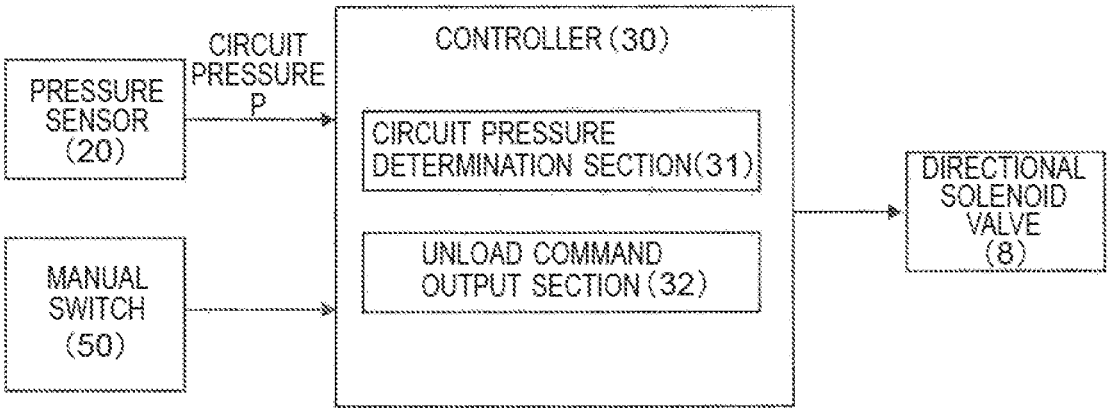
FIG. 3B is a functional block diagram of the controller 30.

As shown in FIG. 3B, a pressure signal from a pressure sensor 20 is inputted to the controller 30, the pressure sensor 20 detecting a circuit pressure P of the sub-flow passage F2. The controller 30 includes a circuit pressure determination section 31 and an unload command output section 32. The circuit pressure determination section 31 determines whether or not the circuit pressure P inputted from the pressure sensor 20 has become equal to or greater than the set pressure Pr of the relief valve 7A. When the circuit pressure P has become equal to or greater than the set pressure Pr, the unload command output section 32 outputs an operation command to the directional solenoid valve 8A. In receiving this operation command, the directional solenoid valve 8A is turned to ON, is switched from the position c to the position d, and guides the pilot pressure to the unload directional valve 6A (refer to FIG. 1).

Also, in the present embodiment, a manual switch 50 for unload is arranged in a cab of a wheel loader not illustrated. When this manual switch 50 is operated by the operator, the operation signal is inputted to the controller 30, and the unload command output section 32 forcibly turns the directional solenoid valve 8A to ON, and switches the unload directional valve 6A to the position b. That is to say, by operation of the manual switch 50, the sub-flow passage F2 is forcibly put into an unload state.

Figure 4:
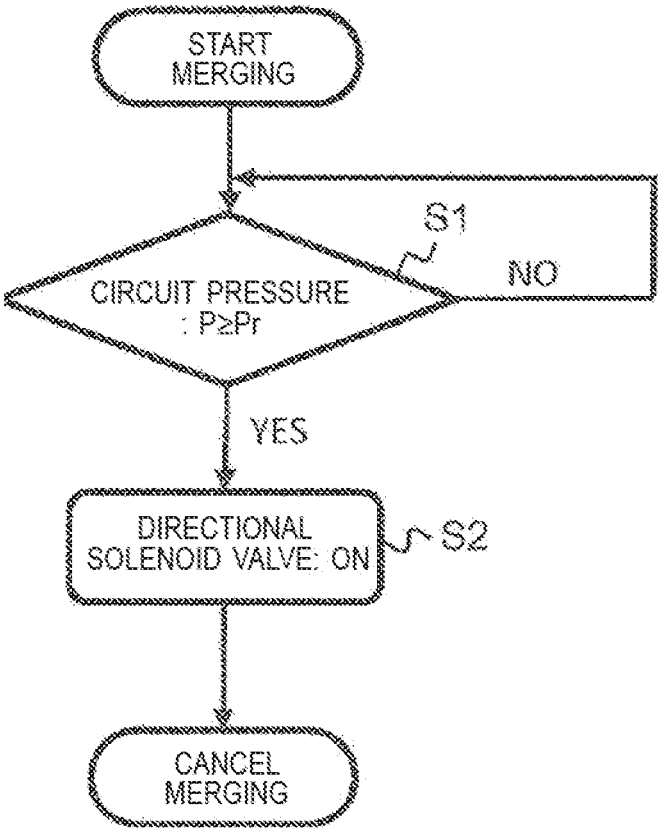
FIG. 4 is a flowchart that shows a procedure of a control process of a directional solenoid valve 8A executed by the controller 30.

Next, a procedure of a control process by the controller 30 will be explained. FIG. 4 is a flowchart that shows a procedure of the control process of the directional solenoid valve 8A executed by the controller 30. As shown in FIG. 4, when merging of the main flow passage F1 and the sub-flow passage F2 starts, the circuit pressure determination section 31 determines whether or not the circuit pressure P is equal to or greater than the set pressure Pr (S1). If "Yes" in S1, the unload command output section 32 outputs an operation command to the directional solenoid valve 8A, and turns the directional solenoid valve 8A (S2) to ON. Also, merging of the main flow passage F1 and the sub-flow passage F2 is cancelled. Further, if "No" in S1, the process returns to S1.

Figure 5:
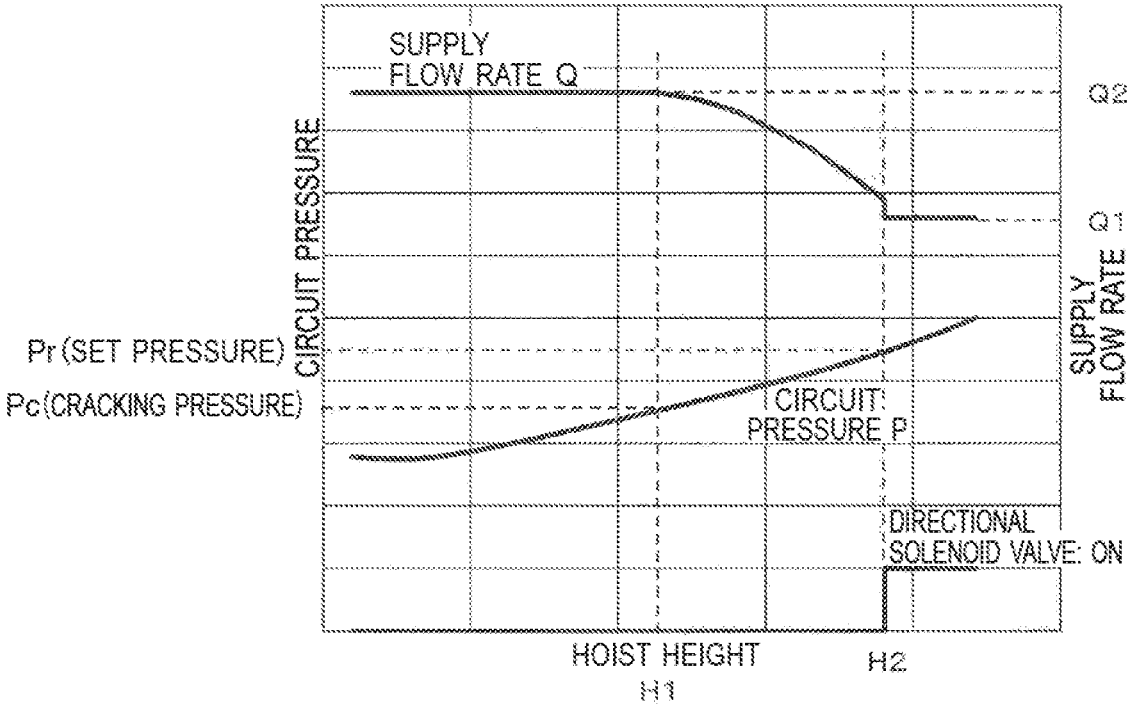
FIG. 5 is a drawing that shows a relation between the flow rate change of pressure oil flowing through a main flow passage F1 and the circuit pressure during an arm raising motion in the first embodiment.

Next, actions and effects of the first embodiment will be explained. FIG. 5 is a drawing that shows a relation between the flow rate change of pressure oil flowing through the main flow passage F1 and the circuit pressure during an arm raising motion in the first embodiment. As shown in FIG. 5, the flow rate (supply flow rate) supplied to the arm cylinder 2 is maintained at Q2 until the hoist height becomes H1 from the initial height in the arm raising motion. Also, the flow rate Q2 is the total flow rate of the pressure oil discharged from the main pump 1 and the pressure oil discharged from the sub-pump 5. Further, when the hoist height reaches H1, the circuit pressure P becomes the cracking pressure Pc, and the relief valve 7A starts to open.

However, since the pressure override characteristic of the relief valve 7A is not excellent, the flow rate Q gradually (moderately) reduces, and when the hoist height reaches H2, the circuit pressure P becomes equal to the set pressure Pr of the relief valve 7A. When the directional solenoid valve 8A is turned to ON at the time point the circuit pressure P becomes equal to the set pressure Pr ("Yes" in S1 of FIG. 4), the state becomes the unload state, merging of the main flow passage F1 and the sub-flow passage F2 is cancelled. Thereby, pressure oil comes to be supplied to the arm cylinder 2 only by a portion of the flow rate Q1 discharged from the main pump 1.

Thus, according to the first embodiment, by using the relief valve 7A whose pressure override characteristic is inferior to normal, the change of the flow rate Q of the pressure oil supplied to the arm cylinder 2 moderately changes while the hoist height changes from H1 to H2, and therefore the impact on the operator operating the arm cylinder 2 with a lever is reduced. In the meantime, when a relief valve having excellent pressure override characteristic is employed, since the flow rate sharply drops from Q2 to Q1 at once at the time point the hoist height is H1, the impact on the operator is larger compared to the relief valve 7A. Also, the hoist height H1 and H2 is a height region corresponding to the height of finishing the arm raising motion after the dump truck loading work for example.

(Modification of Control of Directional Solenoid Valve 8A by Controller 30)

Figure 6:
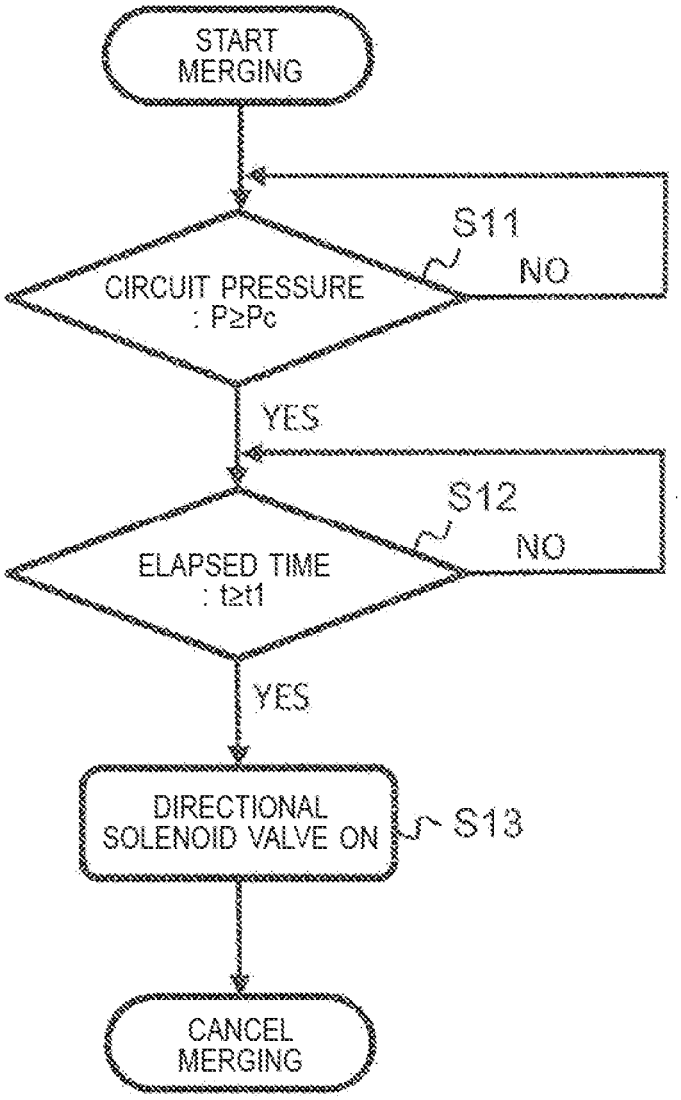
FIG. 6 is a flowchart that shows a modification of the procedure of the control process of the directional solenoid valve 8A executed by the controller 30.

FIG. 6 is a flowchart that shows a modification of the procedure of the control process of the directional solenoid valve 8A executed by the controller 30. In this modification, it is characterized in a point the directional solenoid valve 8A is turned to ON when a predetermined time elapses after the circuit pressure P becomes equal to or greater than the cracking pressure Pc. To be more specific, as shown in FIG. 6, when merging of the main flow passage F1 and the sub-flow passage F2 starts, the circuit pressure determination section 31 determines whether or not the circuit pressure P is equal to or greater than the cracking pressure Pc (S11). If "Yes" in S11, a timer not illustrated works, and the elapsed time t after the circuit pressure P reaches the cracking pressure Pc is measured. The unload command output section 32 determines whether or not the elapsed time t is equal to or greater than a predetermined time t1 (S12). If "Yes" in S12, the unload command output section 32 outputs an operation command to the directional solenoid valve 8A, and turns the directional solenoid valve 8A to ON (S13). Also, merging of the main flow passage F1 and the sub-flow passage F2 is cancelled. Meanwhile, if "No" in S1 and S12, the process returns to S11.

Here, in the case of the first embodiment, as the predetermined time t1, 1 second for example is set (stored) beforehand in the controller 30. This 1 second is the time when the pressure rises from the cracking pressure Pc to the set pressure Pr. That is to say, in this modification, it is controlled so that the directional solenoid valve 8A is turned to ON regarding that the circuit pressure P has reached the set pressure Pr when the circuit pressure P reaches the cracking pressure Pc and 1 second elapses instead that the circuit pressure P reaches the set pressure Pr and the directional solenoid valve 8A is turned to ON. Even in this case, since the change of the flow rate can be made moderate similarly to FIG. 5, the impact on the operator operating the arm cylinder 2 with a lever can be reduced.

Second Embodiment

Figure 7:
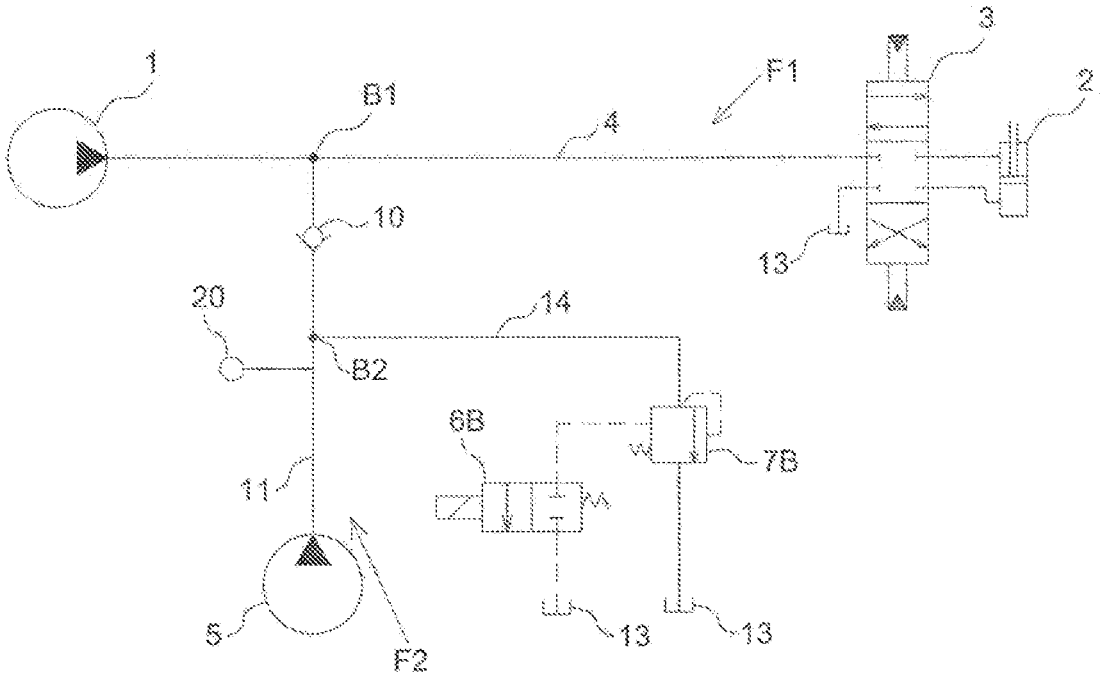
FIG. 7 is a hydraulic circuit diagram that shows a hydraulic drive device for a work vehicle according to a second embodiment of the present invention.

FIG. 7 is a hydraulic circuit diagram that shows a hydraulic drive device for a work vehicle according to a second embodiment of the present invention. As shown in FIG. 7, in the second embodiment, a point configured to achieve an unload state using a vented relief valve 7B is different from the first embodiment. Therefore, in the explanation below, explanation will be made focusing this different point, a configuration same to that of the first embodiment will be marked with a same reference sign, and explanation thereof will be omitted.

In the second embodiment, in a state where the main flow passage F1 and the sub-flow passage F2 are merged with each other, since the unload function of the vented relief valve 7B is made OFF (vent port is closed) and a directional solenoid valve (merging directional valve) 6B is closed, when the circuit pressure P becomes the cracking pressure Pc, pressure oil is gradually relieved from the vented relief valve 7B to the tank 13.

Thereafter, at a time point the circuit pressure P becomes the set pressure Pr (or at a time point the predetermined time t1 elapses after the circuit pressure P reaches the cracking pressure Pc), the directional solenoid valve 6B is opened by the controller 30 (the unload function becomes ON), the vent circuit pressure of the vented relief valve 7B drops to the tank pressure, and thereby the set pressure drops. Therefore, pressure oil discharged from the sub-pump 5 passes through the branch pipe 14 and the vented relief valve 7B, and returns to the tank 13. Thereby, the sub-flow passage F2 is put into an unload state.

Also, in the case of the second embodiment, when the operator operates the manual switch 50, the controller 30 controls the directional solenoid valve 6B so as to open, and the sub-flow passage F2 is forcibly put into an unload state.

In this second embodiment also, by making the pressure override characteristic of the vented relief valve 7B similar to that of the relief valve 7A, actions and effects similar to those of the first embodiment can be exhibited. In addition, in the second embodiment, there is also an advantage of simplifying the unload circuit by using the vented relief valve 7B.

Third Embodiment

Figure 8:
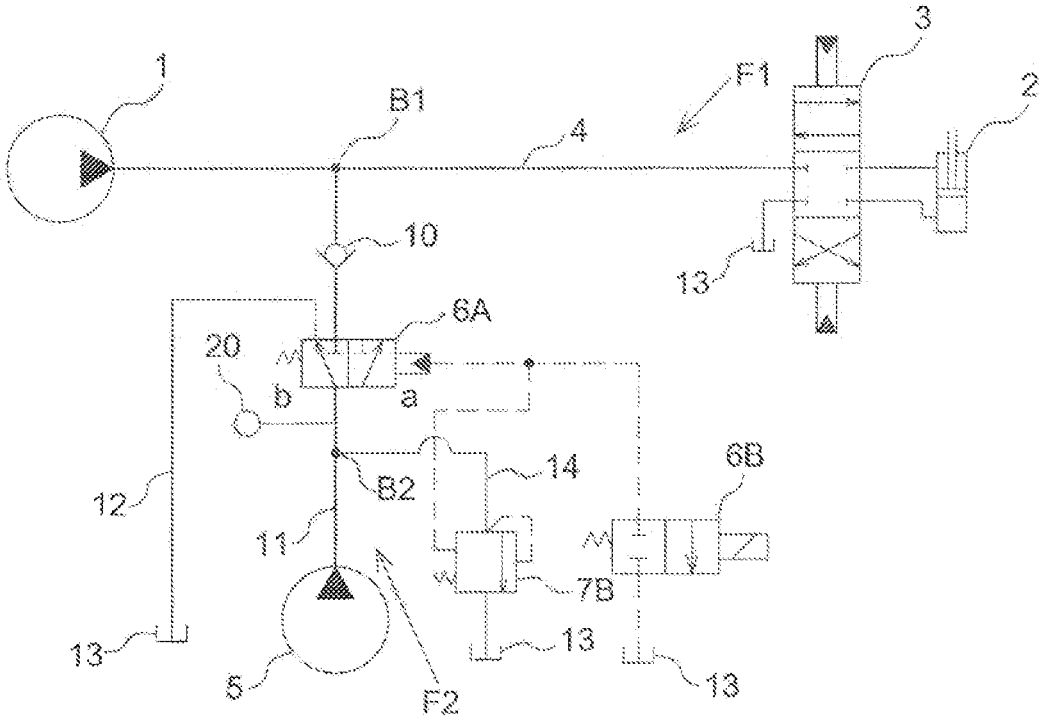
FIG. 8 is a hydraulic circuit diagram that shows a hydraulic drive device for a work vehicle according to a third embodiment of the present invention.

FIG. 8 is a hydraulic circuit diagram that shows a hydraulic drive device for a work vehicle according to a third embodiment of the present invention. As shown in FIG. 8, in the third embodiment, a point configured to achieve an unload state using the vented relief valve 7B, the unload directional valve 6A, and the directional solenoid valve 6B is different from the first and second embodiments. Also, a configuration same to that of the first and second embodiments will be marked with a same reference sign, and explanation thereof will be omitted.

In the third embodiment, since the directional solenoid valve 6B is closed when the unload function is made OFF, pressure oil discharged from the sub-pump 5 is introduced to the unload directional valve 6A through the vent port of the vented relief valve 7B. Thereby, the unload directional valve 6A is switched to the position b, and the main flow passage F1 and the sub-flow passage F2 merge with each other. In this state, when the circuit pressure P becomes the cracking pressure Pc, pressure oil is gradually relieved from the vented relief valve 7B to the tank 13.

Thereafter, when the directional solenoid valve 6B is opened by the controller 30 at a time point the circuit pressure P becomes the set pressure Pr (or at a time point the predetermined time t1 elapses after the circuit pressure P reaches the cracking pressure Pc), pressure oil (control pressure) having been applied to the unload directional valve 6A returns to the tank 13 through the directional solenoid valve 6B. Therefore, the unload directional valve 6A is switched to the position a, and pressure oil discharged from the sub-pump 5 flows through the return pipe 12 and returns to the tank 13. Thereby, the sub-flow passage F2 is put into an unload state.

In this third embodiment also, actions and effects similar to those of the first and second embodiment can be exhibited. Also, since the third embodiment is configured to return the pressure oil from the sub-pump 5 to the tank 13 through the unload directional valve 6A, the pressure loss can be reduced compared to a configuration of returning the pressure oil from the sub-pump 5 to the tank 13 through the vented relief valve 7B as the second embodiment. Therefore, the third embodiment has a higher energy saving effect compared to the second embodiment.

Fourth Embodiment

Figure 9:
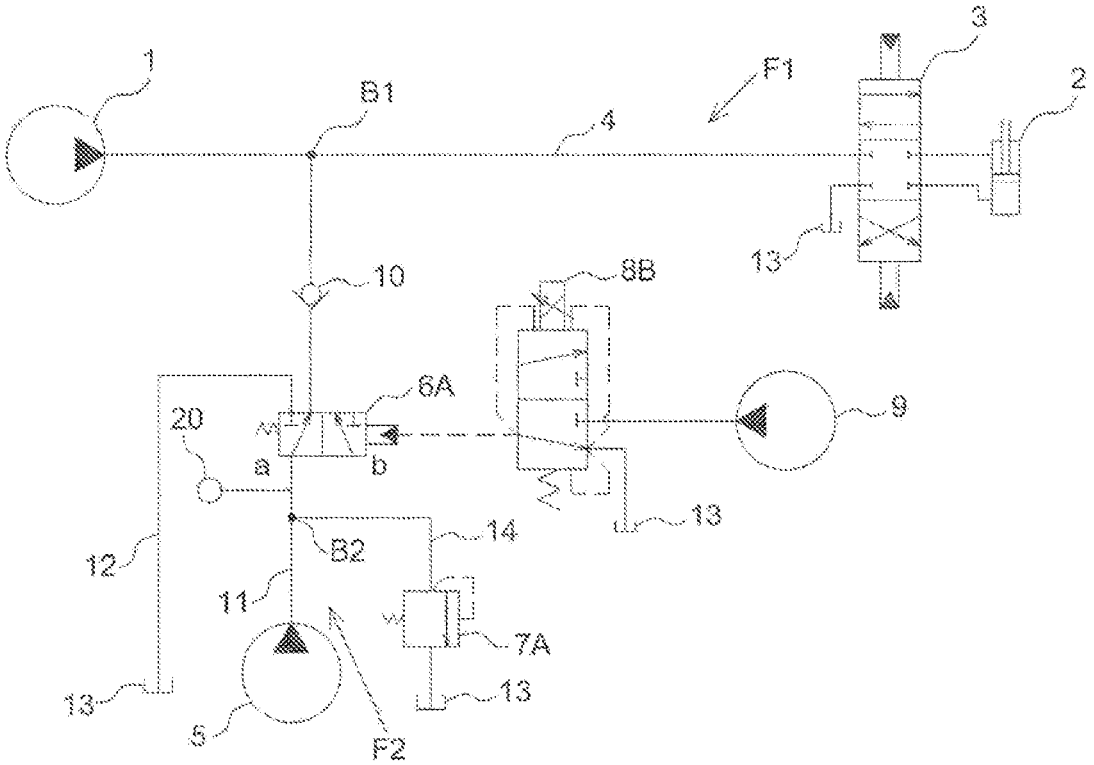
FIG. 9 is a hydraulic circuit diagram that shows a hydraulic drive device for a work vehicle according to a fourth embodiment of the present invention.

FIG. 9 is a hydraulic circuit diagram that shows a hydraulic drive device for a work vehicle according to a fourth embodiment of the present invention. As shown in FIG. 9, the fourth embodiment is different from the first embodiment in a point configured to operate the unload directional valve 6A using a proportional solenoid valve 8B instead of the directional solenoid valve 8A. Therefore, the procedure of the control process by the controller 30 is different.

Figure 10:
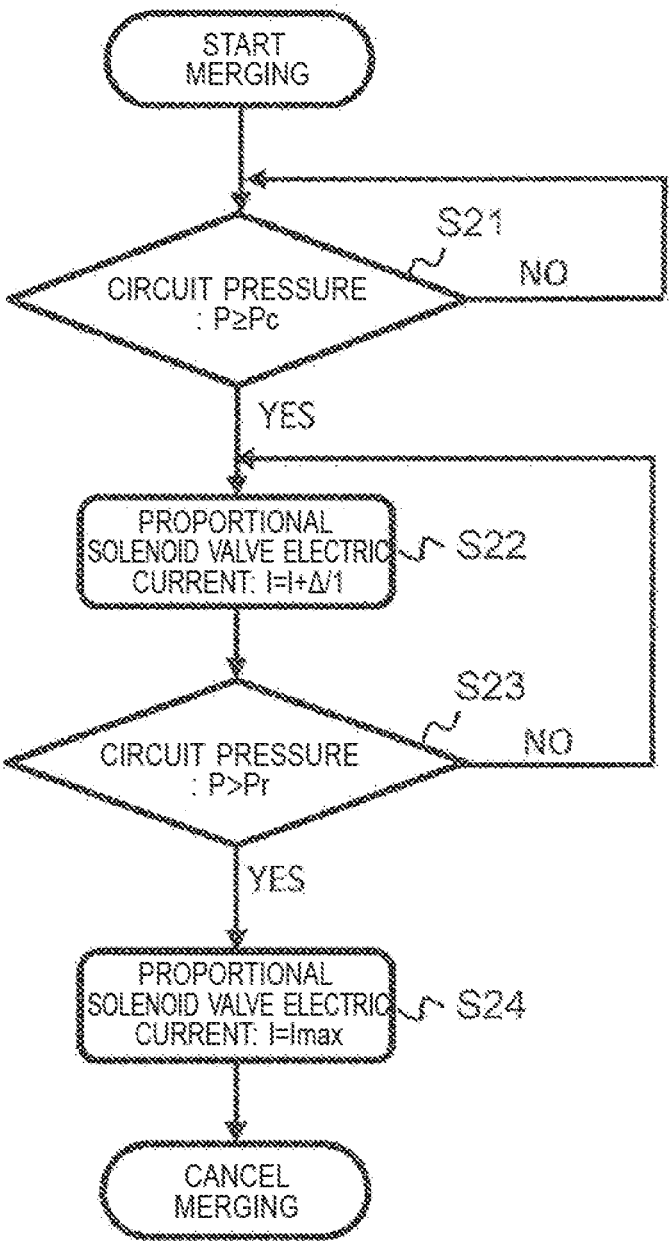
FIG. 10 is a flowchart that shows a procedure of a control process of a proportional solenoid valve 8B executed by the controller 30.

FIG. 10 is a flowchart that shows a procedure of the control process of the proportional solenoid valve 8B executed by the controller 30. As shown in FIG. 10, when merging of the main flow passage F1 and the sub-flow passage F2 starts, the circuit pressure determination section 31 determines whether or not the circuit pressure P is equal to or greater than the cracking pressure Pc (S21). If "Yes" in S21, the unload command output section 32 applies a control current I ($I=I+\Delta/1$) to the proportional solenoid valve 8B (S22). Here, $\Delta/1$ is an electric current increment per unit time of the proportional solenoid valve 8B.

Next, the circuit pressure determination section 31 determines whether or not the circuit pressure P has exceeded the set pressure Pr (S23). If "Yes" in S23, the unload command output section 32 applies the maximum value (Imax) of the control current I to the proportional solenoid valve 8B (S24). Also, merging of the main flow passage F1 and the sub-flow passage F2 is cancelled. Further, the process returns to S21 if "No" in S21, and the process returns to S22 if "No" in S23.

Figure 11:
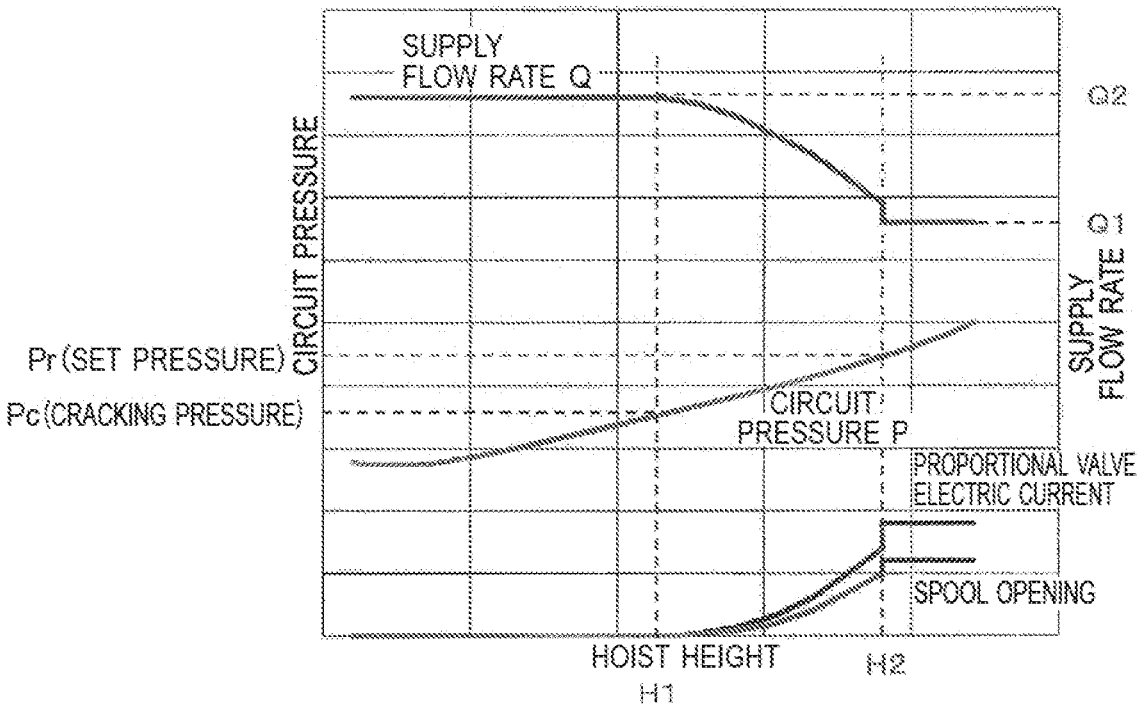
FIG. 11 is a drawing that shows a relation between the flow rate change of pressure oil flowing through the main flow passage F1 and the circuit pressure during an arm raising motion in the fourth embodiment.

Next, actions and effects of the fourth embodiment will be explained. FIG. 11 is a drawing that shows a relation between the flow rate change of pressure oil flowing through the main flow passage F1 and the circuit pressure during an arm raising motion in the fourth embodiment. As is clear in comparing FIG. 5 and FIG. 11, the fourth embodiment is different from the first embodiment in that the electric current is applied gradually to the proportional solenoid valve 8B and the spool opening of the proportional solenoid valve 8B gradually opens while the hoist height changes from H1 to H2.

Thus, according to the fourth embodiment, similarly to the first embodiment, since the change of the flow rate of the pressure oil supplied to the arm cylinder 2 moderately changes while the hoist height changes from H1 to H2, the impact on the operator operating the arm cylinder 2 with a lever is reduced.

(First Modification of Control of Proportional Solenoid Valve 8B by Controller 30)

Figure 12:
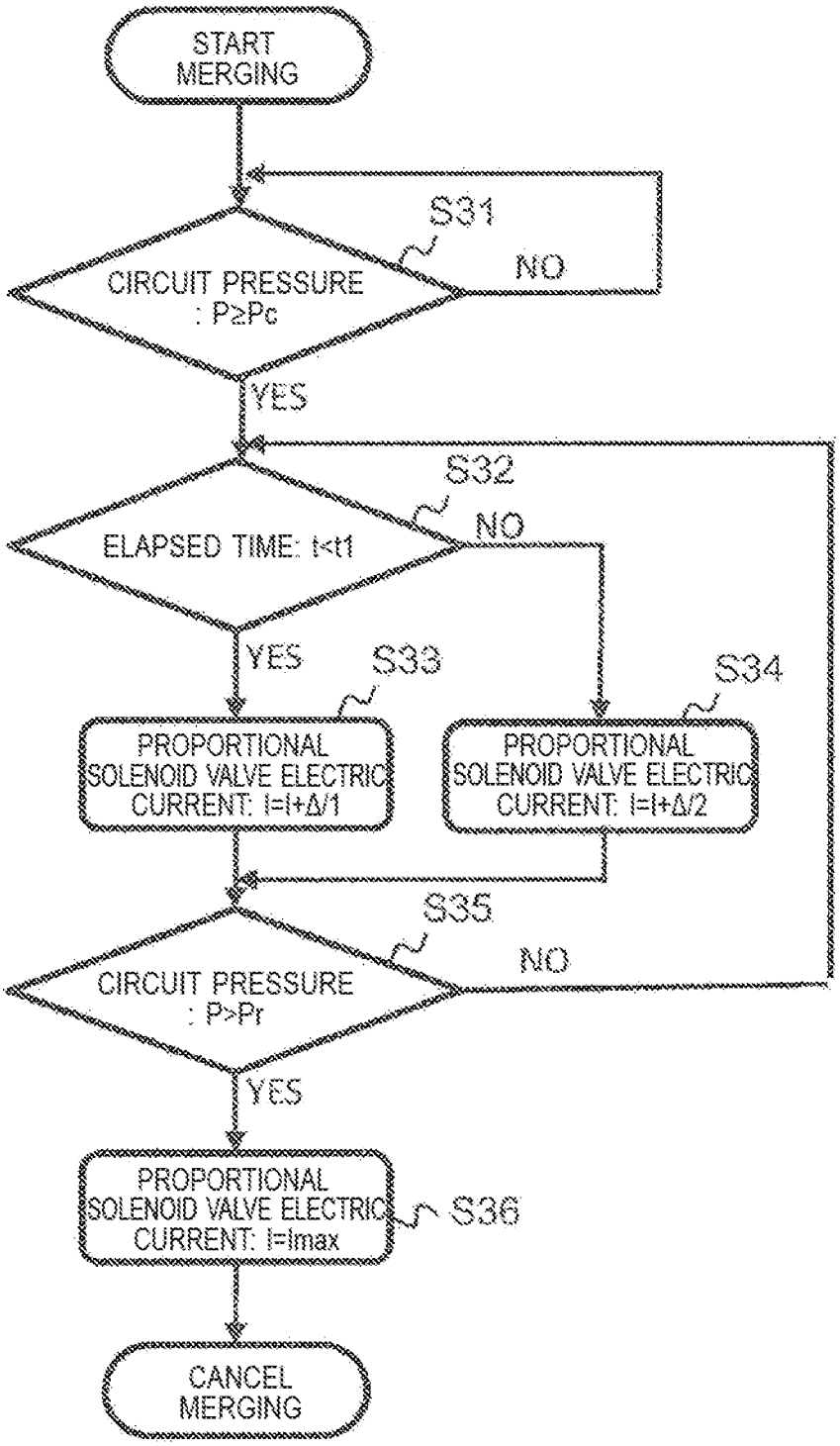
FIG. 12 is a flowchart that shows a first modification of the procedure of the control process of the proportional solenoid valve 8B executed by the controller 30.

FIG. 12 is a flowchart that shows a first modification of the procedure of the control process of the proportional solenoid valve 8B executed by the controller 30. As shown in FIG. 12, when merging of the main flow passage F1 and the sub-flow passage F2 starts, the circuit pressure determination section 31 determines whether or not the circuit pressure P is equal to or greater than the cracking pressure Pc (S31). If "Yes" in S31, the timer not illustrated works, and the elapsed time t after the circuit pressure P reaches the cracking pressure Pc is measured. The unload command output section 32 determines whether or not the elapsed time t is less than the predetermined time t1 (S32). Also, similarly to FIG. 6, the predetermined time t1 is set to 1 second.

If "Yes" in S32, the unload command output section 32 applies the control current I ($I=I+\Delta/1$) to the proportional solenoid valve 8B (S33). Meanwhile, if "No" in S32, the unload command output section 32 applies the control current I ($I=I+\Delta/2$) to the proportional solenoid valve 8B (S34). Also, $\Delta/1$ and $\Delta/2$ are an electric current increment per unit time, and $\Delta/1<\Delta/2$. Next, the circuit pressure determination section 31 determines whether or not the circuit pressure P has exceeded the set pressure Pr (S35). If "Yes" in S35, the unload command output section 32 applies the maximum value (Imax) of the control current I to the proportional solenoid valve 8B (S36). Also, merging of the main flow passage F1 and the sub-flow passage F2 is cancelled. Further, the process returns to S31 if "No" in S31, and the process returns to S32 if "No" in S35. Even in this case, since the change of the flow rate can be made moderate, the impact on the operator operating the arm cylinder 2 with a lever can be reduced.

(Second Modification of Control of Proportional Solenoid Valve 8B by Controller 30)

Figure 13:
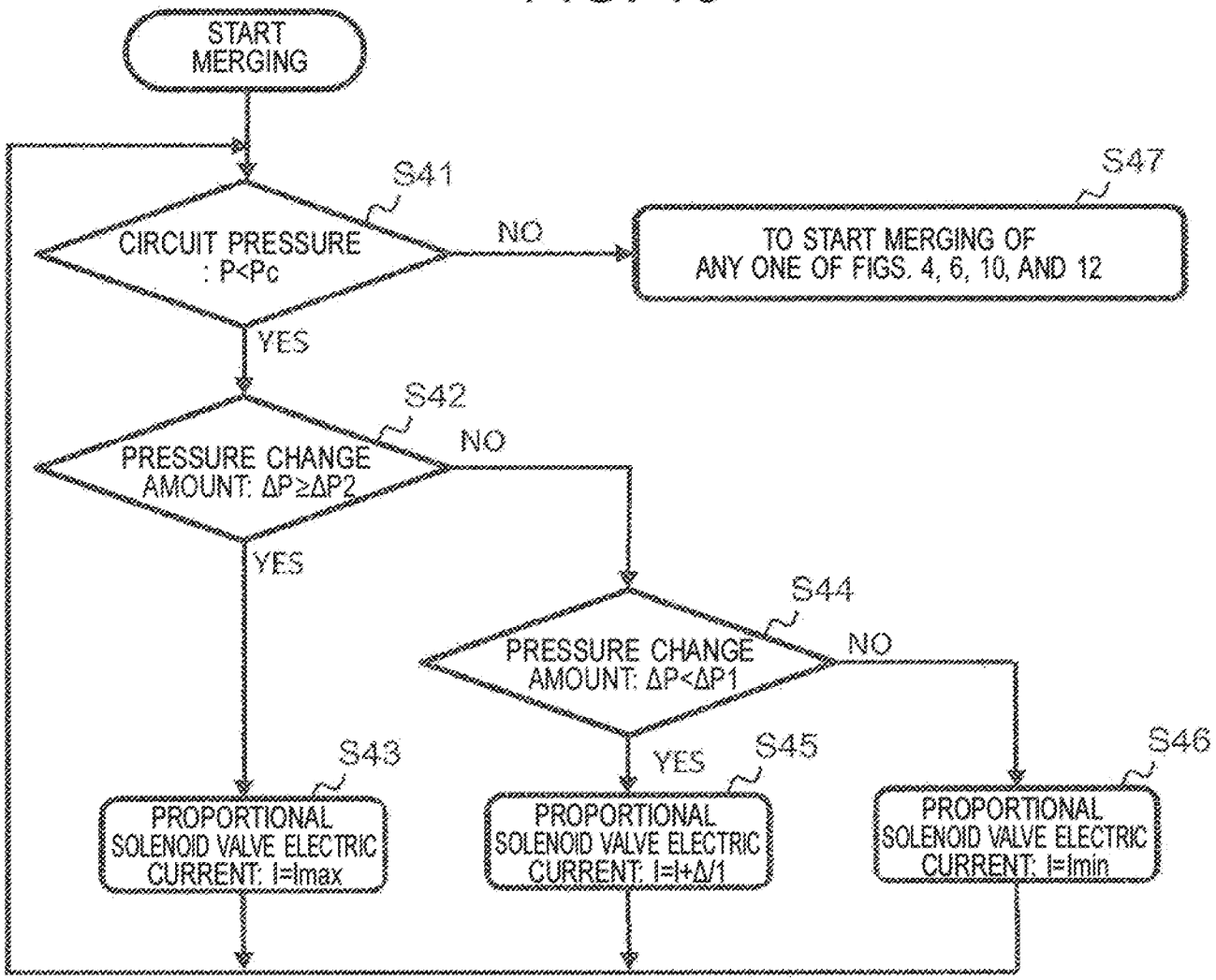
FIG. 13 is a flowchart that shows a second modification of the procedure of the control process of the proportional solenoid valve 8B executed by the controller 30.

FIG. 13 is a flowchart that shows a second modification of the procedure of the control process of the proportional solenoid valve 8B executed by the controller 30. As shown in FIG. 13, when merging of the main flow passage F1 and the sub-flow passage F2 starts, the circuit pressure determination section 31 determines whether or not the circuit pressure P is less than the cracking pressure Pc (S41). If "Yes" in S41, the circuit pressure determination section 31 determines whether or not the pressure change amount $\Delta P$ per unit time of the circuit pressure P is equal to or greater than a threshold value $\Delta P2$ (S42). If "Yes" in S42, the unload command output section 32 applies the maximum value (Imax) of the control current I to the proportional solenoid valve 8B (S43).

Meanwhile, if "No" in S42, the circuit pressure determination section 31 determines whether or not the pressure change amount $\Delta P$ is less than the threshold value $\Delta P1$ (S44). Here, $\Delta P1<\Delta P2$. If "Yes" in S44, the unload command output section 32 applies the control current I ($I=I+\Delta/1$) to the proportional solenoid valve 8B (S45). If "No" in S44, the unload command output section 32 applies the minimum value (Imin) of the control current I (S46). Also, if "No" in S41, the process after starting merging of any one of FIGS. 4, 6, 10, and 12 is executed. Even in this case, since the change of the flow rate can be made moderate, the impact on the operator operating the arm cylinder 2 with a lever can be reduced.

Fifth Embodiment

Figure 14:
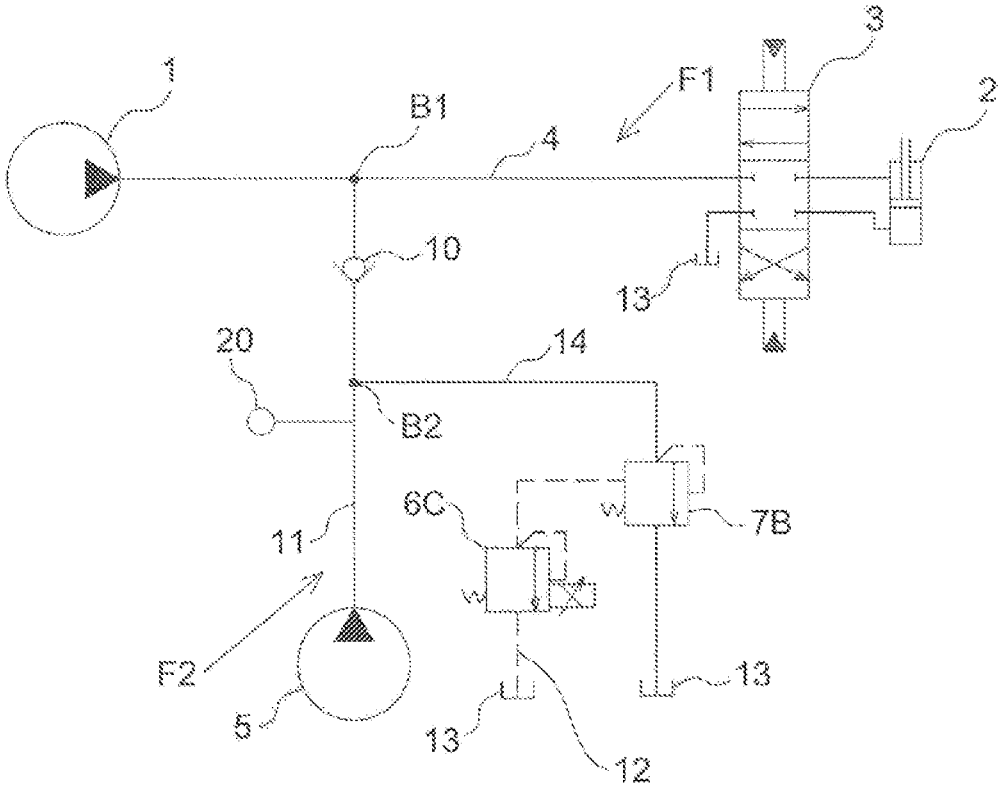
FIG. 14 is a hydraulic circuit diagram that shows a hydraulic drive device for a work vehicle according to a fifth embodiment of the present invention.

FIG. 14 is a hydraulic circuit diagram that shows a hydraulic drive device for a work vehicle according to a fifth embodiment of the present invention. As shown in FIG. 14, the fifth embodiment is obtained by arranging a proportional solenoid valve 6C instead of the directional solenoid valve 6B of the second embodiment shown in FIG. 7. Even in this configuration, actions and effects similar to those of the second embodiment can be exhibited.

Sixth Embodiment

Figure 15:
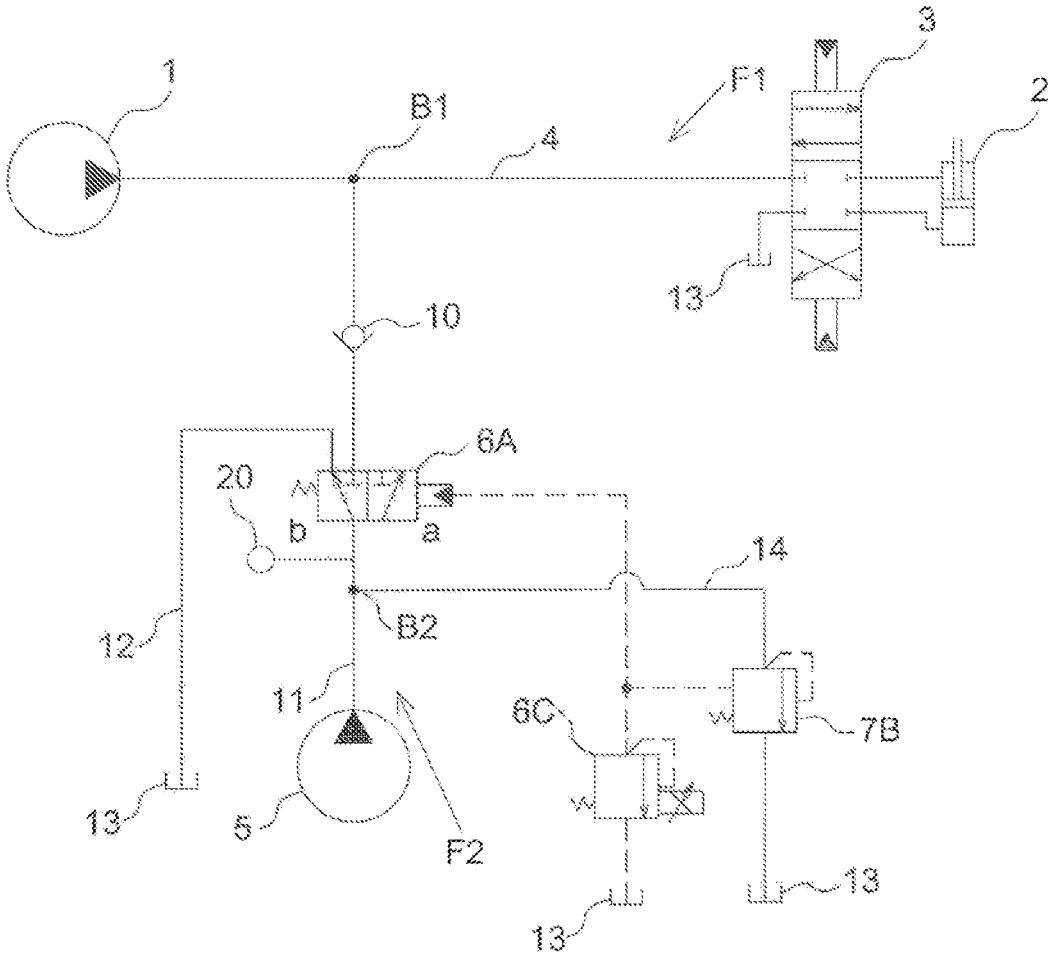
FIG. 15 is a hydraulic circuit diagram that shows a hydraulic drive device for a work vehicle according to a sixth embodiment of the present invention.

FIG. 15 is a hydraulic circuit diagram that shows a hydraulic drive device for a work vehicle according to a sixth embodiment of the present invention. As shown in FIG. 15, the sixth embodiment is obtained by arranging the proportional solenoid valve 6C instead of the directional solenoid valve 6B of the third embodiment shown in FIG. 8. Even in this configuration, actions and effects similar to those of the third embodiment can be exhibited.

Seventh to Twelfth Embodiments

FIG. 16 to FIG. 21 are hydraulic circuit diagrams that show a hydraulic drive device for a work vehicle according to seventh to twelfth embodiments of the present invention respectively. Although FIG. 16 to FIG. 21 have a configuration same to that of FIG. 1, FIG. 7, FIG. 8, FIG. 9, FIG. 14, and FIG. 15 respectively, they are different in whether or not being unloaded in a normal state. That is to say, between the first to sixth embodiments and the seventh to twelfth embodiments, setting of the initial position of the unload directional valve 6A, the initial position of the directional solenoid valve 6B, or the initial position of the proportional solenoid valve 6C becomes opposite. Even in these seventh to twelfth embodiments, such point remains unchanged that the impact of the time the operator executes a lever operation can be reduced.

Figure 16:
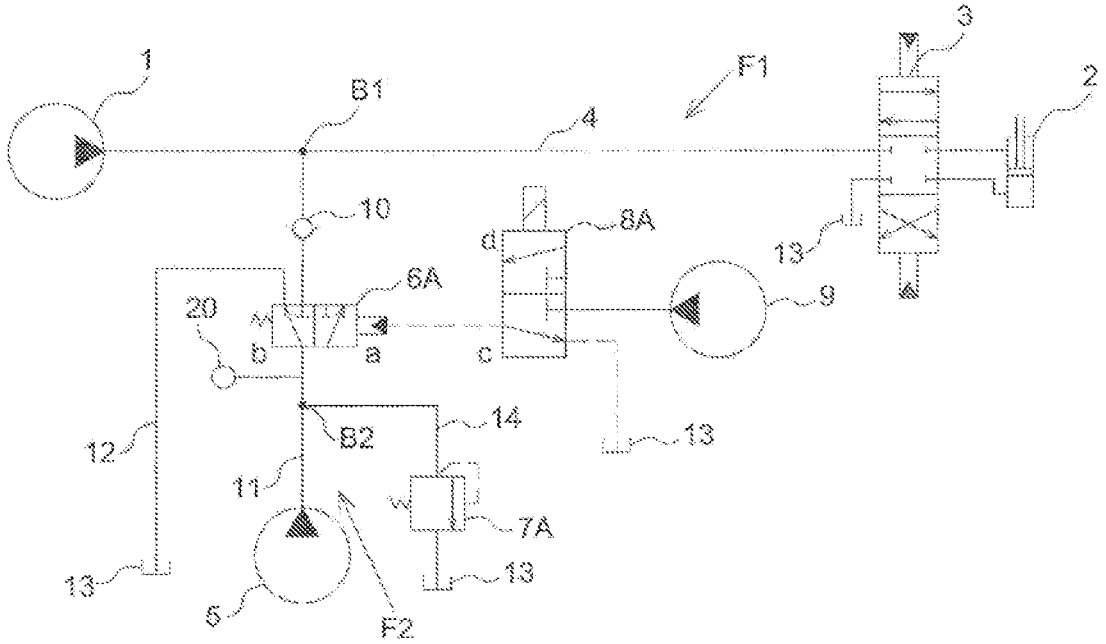
FIG. 16 is a hydraulic circuit diagram that shows a hydraulic drive device for a work vehicle according to a seventh embodiment of the present invention.
Figure 17:
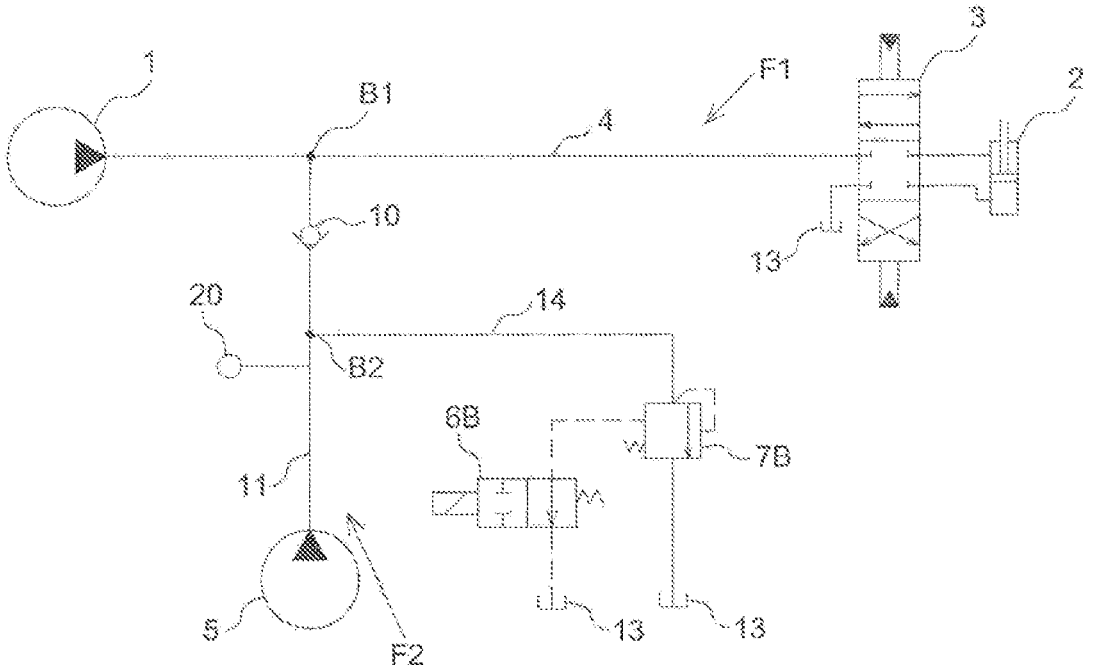
FIG. 17 is a hydraulic circuit diagram that shows a hydraulic drive device for a work vehicle according to an eighth embodiment of the present invention.
Figure 18:
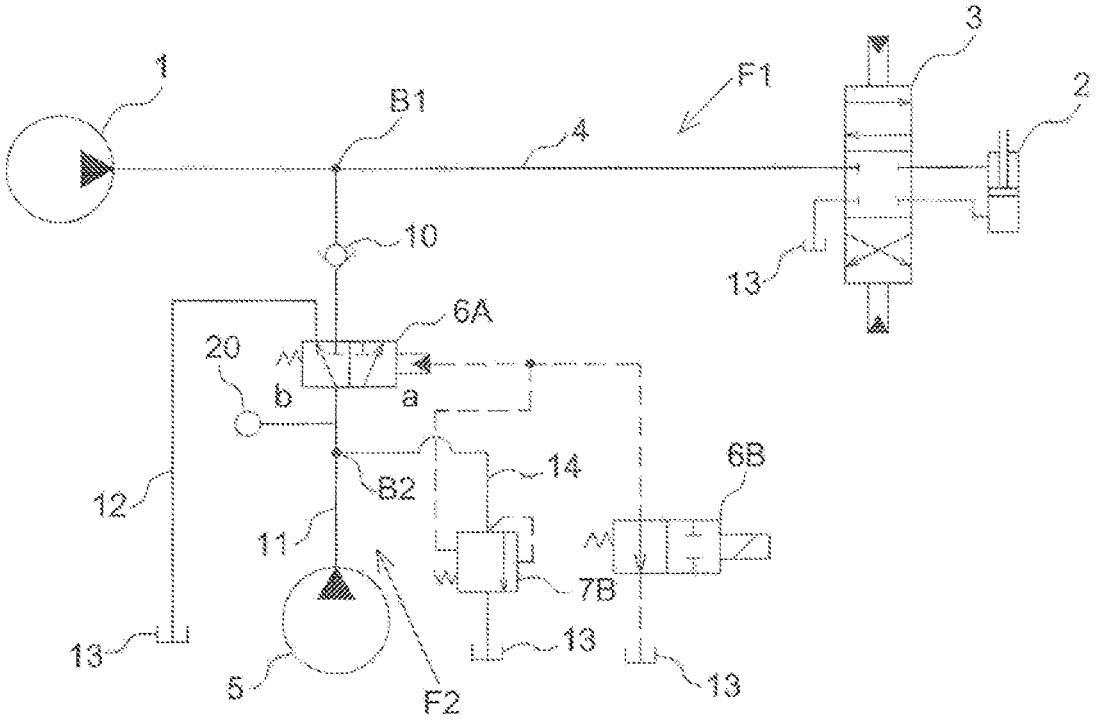
FIG. 18 is a hydraulic circuit diagram that shows a hydraulic drive device for a work vehicle according to a ninth embodiment of the present invention.
Figure 19:
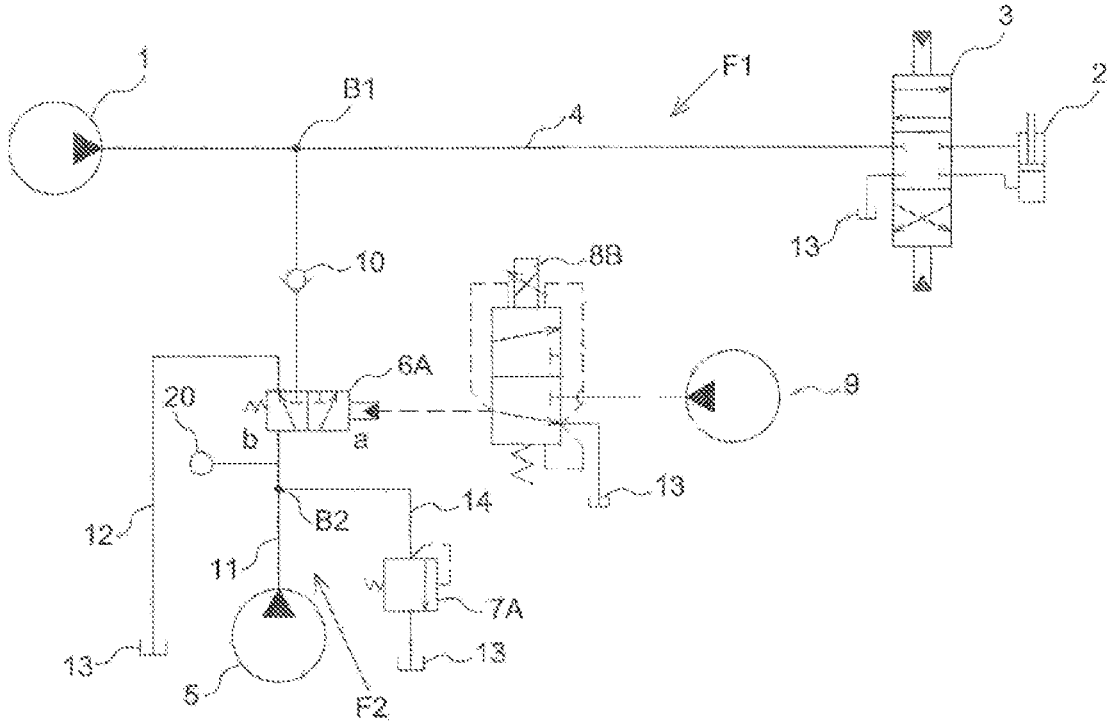
FIG. 19 is a hydraulic circuit diagram that shows a hydraulic drive device for a work vehicle according to a tenth embodiment of the present invention.
Figure 20:
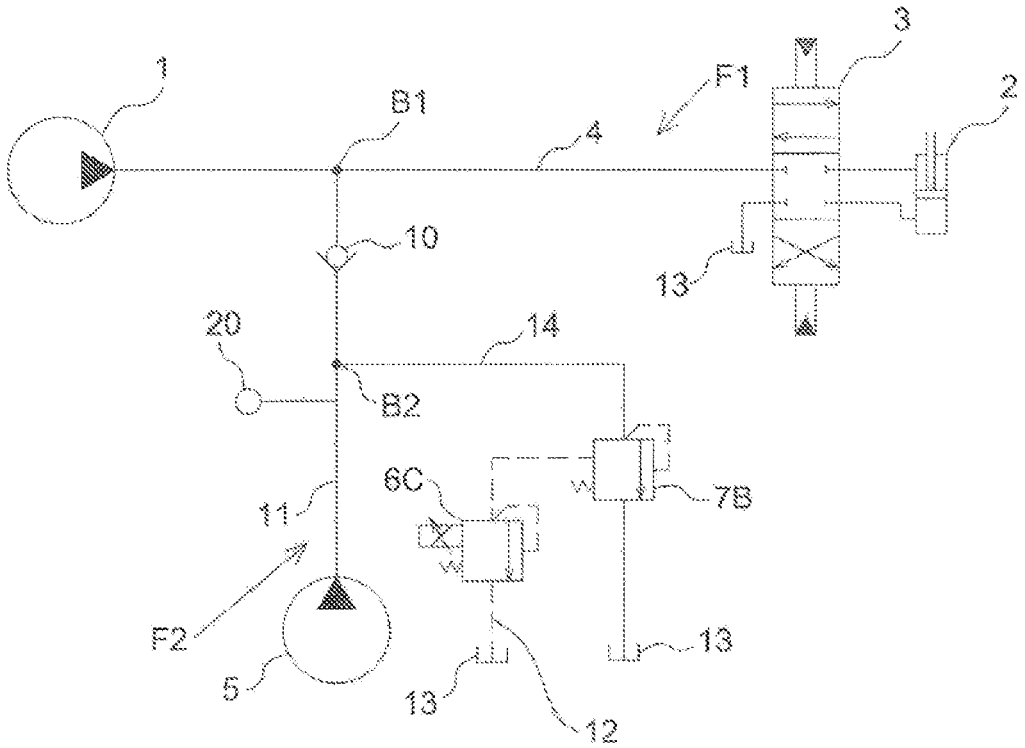
FIG. 20 is a hydraulic circuit diagram that shows a hydraulic drive device for a work vehicle according to an eleventh embodiment of the present invention.
Figure 21:
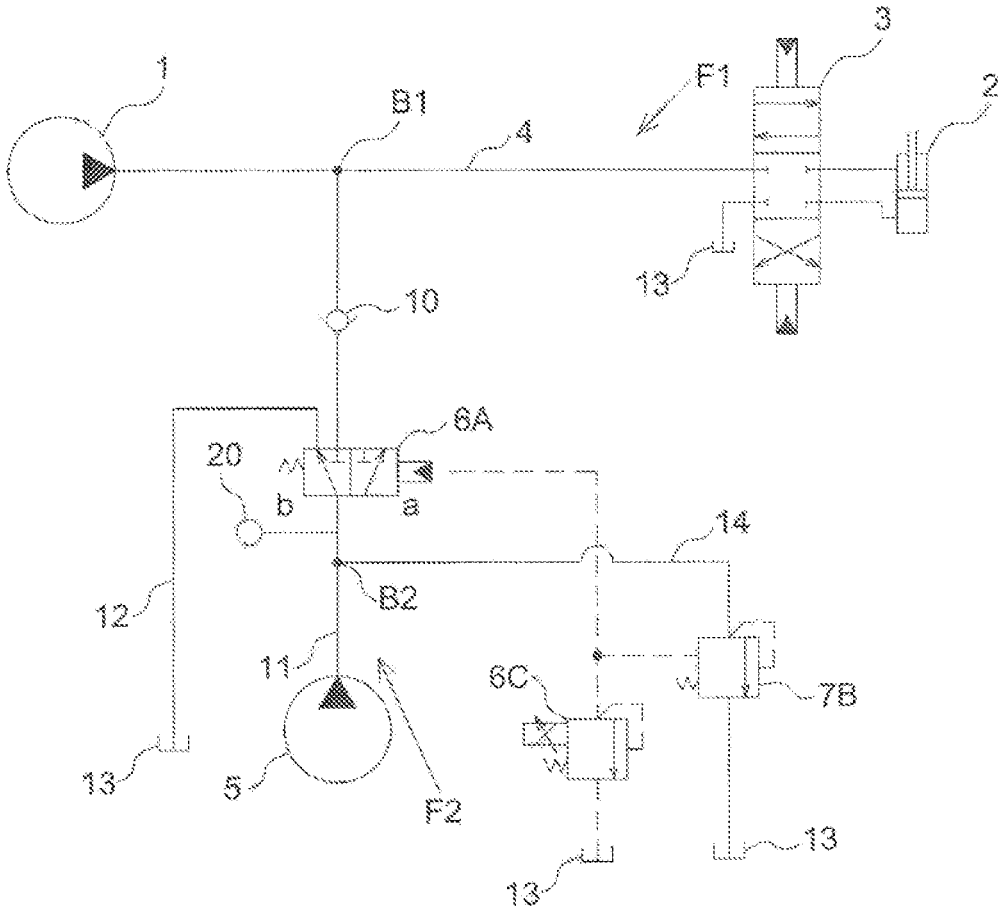
FIG. 21 is a hydraulic circuit diagram that shows a hydraulic drive device for a work vehicle according to a twelfth embodiment of the present invention.
Figure 22:
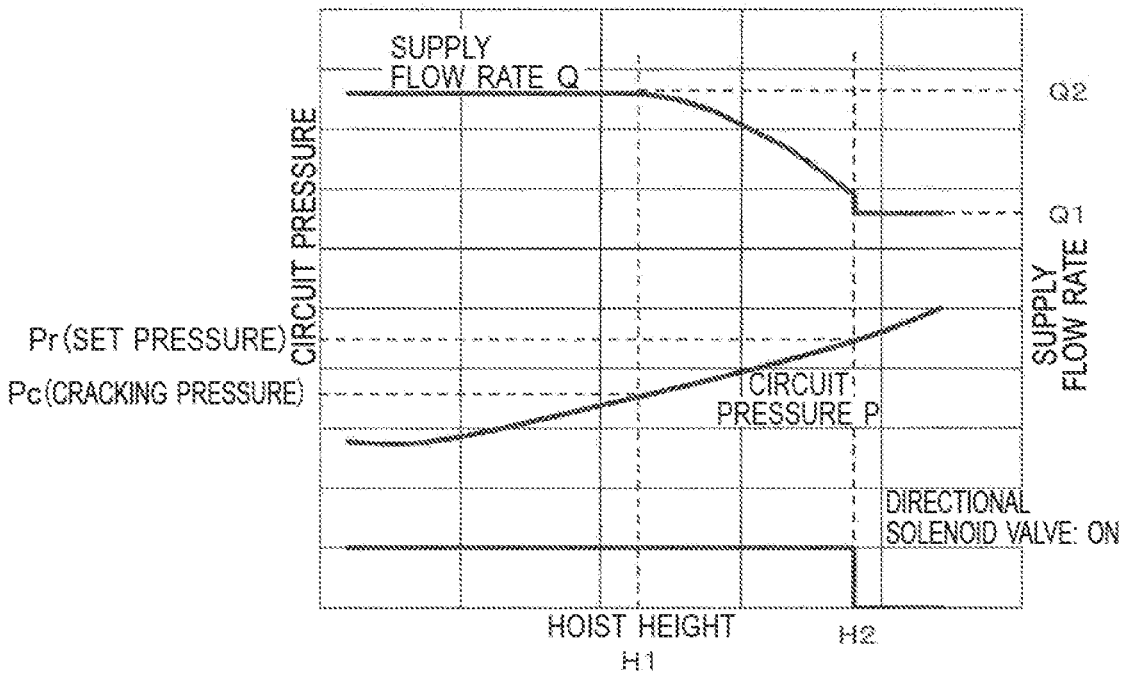
FIG. 22 is a drawing that shows a relation between the flow rate change of pressure oil flowing through the main flow passage F1 and the circuit pressure during an arm raising motion in the seventh to ninth embodiments.
Figure 23:
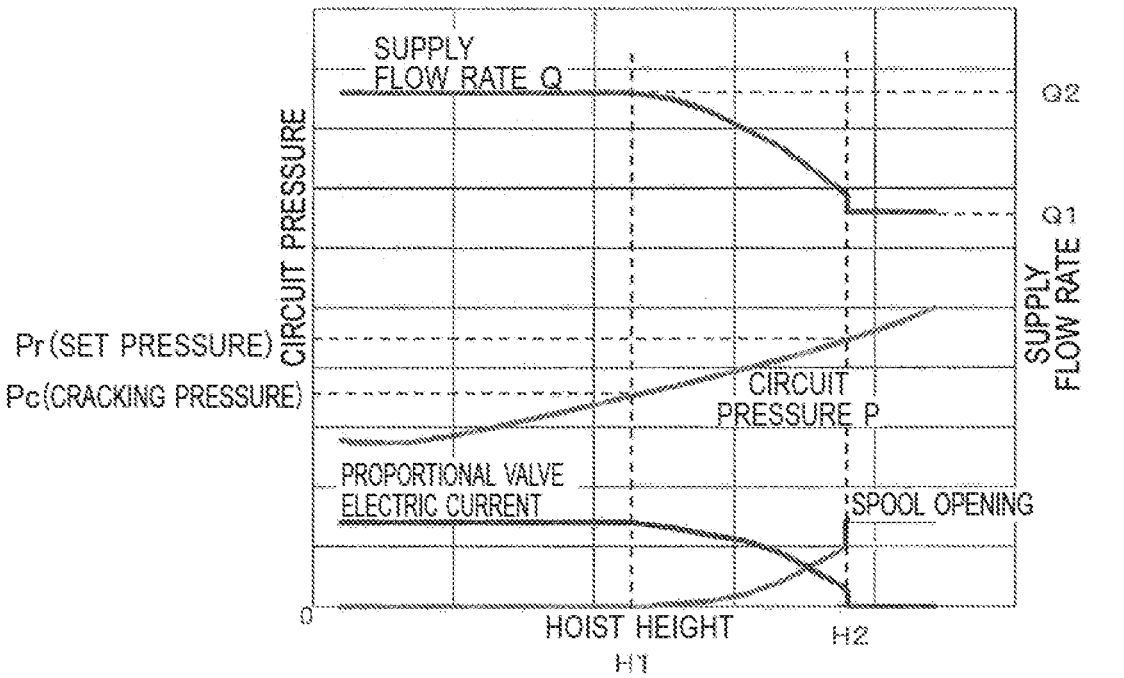
FIG. 23 is a drawing that shows a relation between the flow rate change of pressure oil flowing through the main flow passage F1 and the circuit pressure during an arm raising motion in the tenth to twelfth embodiments.

FIG. 22 is a drawing that shows a relation between the flow rate change of pressure oil flowing through the main flow passage F1 and the circuit pressure during an arm raising motion in the seventh to ninth embodiments shown in FIG. 16 to FIG. 18. Also, FIG. 23 is a drawing that shows a relation between the flow rate change of pressure oil flowing through the main flow passage F1 and the circuit pressure during an arm raising motion in the tenth to twelfth embodiments shown in FIG. 19 to FIG. 21. As is clear comparing with FIG. 5, FIG. 22 is opposite in terms of the behavior of the directional solenoid valve, but is same in that the flow rate Q moderately reduces in the range of the hoist height H1 to H2. Also, as is clear comparing with FIG. 11, FIG. 23 is opposite in terms of the behavior of the proportional valve electric current and the spool opening, but is same in that the flow rate Q moderately reduces in the range of the hoist height H1 to H2. Therefore, even in the configuration of the seventh to twelfth embodiments, the impact on the operator at the time of operating the arm cylinder 2 is reduced.

As explained above, according to the hydraulic drive device according to the first to twelfth embodiments, by using a relief valve whose pressure override characteristic is inferior to normal when merging of the main flow passage F1 and the sub-flow passage F2 is cancelled, the flow rate Q of the main flow passage F1 can be reduced gradually taking an advantage of the characteristic of the relief valve, and therefore the impact on the operator at the time of operation of the arm cylinder 2 with a lever can be suppressed. That is to say, since the impact on the operator is reduced by moderating the change of the flow rate at the time of switching merging of the main flow passage F1 and the sub-flow passage F2, operability of the arm cylinder improves. Also, since the manual switch 50 is arranged, the arm cylinder can be operated by an intention of an operator, and usability is excellent. Further, by returning the pressure oil to the tank 13 at the time of unloading, energy loss can be suppressed. Furthermore, by employing a gear pump as the sub-pump 5, the hydraulic drive device can be produced at a low cost.

Also, the present invention is not limited to the embodiments described above, various modifications are possible within a range not departing from the gist of the present invention, and all of the technical items included in the technical thought described in the claims become the object of the present invention. Although the embodiments described above showed suitable examples, a person with an ordinary skill in the art can achieve various kinds of alternatives, amendments, modifications, or improvements from the contents disclosed in the present description, and they are included in the technical range described in the attached claims.

Also, the work vehicle to which the hydraulic drive device according to the present invention is applied is not limited to a wheel loader, and may be a fork lift, bulldozer, hydraulic excavator, and so on. Further, the hydraulic drive device according to the present invention can be applied to various kinds of hydraulic actuators such as a bucket cylinder and a steering cylinder in addition to the arm cylinder.

Also, by configuring respective embodiments described above so as to input the stroke amount of the arm angle sensor or the arm cylinder to the controller 30 and to be switched to an unload state based on the input signal of them, the time from the time point the circuit pressure P becomes the set pressure Pr until achieving the unload state can be shortened further. In addition, it is also possible to input various kinds of signals such as a cargo handling operation signal, a parking brake signal, and a hoist raising signal to the controller 30, and to be switched to unloading.

REFERENCE SIGNS LIST

1 . . . Main pump
2 . . . Arm cylinder (actuator)
5 . . . Sub-pump
6A . . . Unload directional valve (merging directional valve)
6B . . . Directional solenoid valve (merging directional valve)
6C . . . Proportional solenoid valve (merging directional valve)
7A . . . Relief valve
7B . . . Vented relief valve
8A . . . Directional solenoid valve
8B . . . Proportional solenoid valve
12 . . . Return pipe (return flow passage)
13 . . . Tank
20 . . . Pressure sensor
30 . . . Controller
50 . . . Manual switch
F1 . . . Main flow passage
F2 . . . Sub-flow passage

The invention claimed is:

1. A hydraulic drive device for a work vehicle, comprising:
- a main pump of a variable displacement type or a fixed displacement type, the main pump discharging pressure oil;
- a main flow passage for supplying pressure oil of the main pump to an actuator;
- a sub-pump of a fixed displacement type discharging pressure oil;
- a sub-flow passage for making pressure oil of the sub-pump merge with the main flow passage and supplying the pressure oil to the actuator;
- a merging directional valve for connecting or cutting off the main flow passage and the sub-flow passage;
- a controller for controlling operation of the merging directional valve; and
- a relief valve arranged in the sub-flow passage,
- a return flow passage that connects the merging directional valve and a tank, and
- a pressure sensor that detects pressure of the sub-flow passage,
  - wherein the relief valve has a pressure override characteristic having a tendency that the relief pressure increases from a cracking pressure to a set pressure as a relief flow rate increases,
  - wherein the sub-flow passage and the return flow passage communicate with each other through the merging directional valve in case the merging directional valve operates and the main flow passage and the sub-flow passage are cut off, and
  - wherein the controller operates the merging directional valve and cuts off the main flow passage and the sub-flow passage in case a predetermined time elapses after a pressure signal inputted from the pressure sensor reaches the cracking pressure.

2. The hydraulic drive device for a work vehicle according to claim 1, further comprising:
- a manual switch that is for forcibly operating the merging directional valve by the controller.

3. A hydraulic drive device for a work vehicle, comprising:
- a main pump of a variable displacement type or a fixed displacement type, the main pump discharging pressure oil;
- a main flow passage for supplying pressure oil of the main pump to an actuator;
- a sub-pump of a fixed displacement type discharging pressure oil;
- a sub-flow passage for making pressure oil of the sub-pump merge with the main flow passage and supplying the pressure oil to the actuator;

a merging directional valve for connecting or cutting off the main flow passage and the sub-flow passage;

a controller for controlling operation of the merging directional valve; and a relief valve arranged in the sub-flow passage, a return flow passage that connects the merging directional valve and a tank, and a pressure sensor that detects pressure of the sub-flow passage, wherein the relief valve has a pressure override characteristic having a tendency that the relief pressure increases from a cracking pressure to a set pressure as a relief flow rate increases, wherein the sub-flow passage and the return flow passage communicate with each other through the merging directional valve in case the merging directional valve operates and the main flow passage and the sub-flow passage are cut off, and wherein the controller operates the merging directional valve and cuts off the main flow passage and the sub-flow passage in case a pressure signal inputted from the pressure sensor reaches the set pressure.

4. The hydraulic drive device for a work vehicle according to claim 3, further comprising:

a manual switch that is for forcibly operating the merging directional valve by the controller.

* * * * *